US006881136B1

(12) United States Patent
Chuang

(10) Patent No.: US 6,881,136 B1
(45) Date of Patent: Apr. 19, 2005

(54) GRINDING-BAND SWAYING DEVICE FOR A BAND GRINDING MACHINE

(76) Inventor: Po Chang Chuang, No. 222, Tsung-Yi 6th St., Taiping City (TW) 411

( * ) Notice: Subject to any disclaimer, the term of this patent is extended or adjusted under 35 U.S.C. 154(b) by 0 days.

(21) Appl. No.: 10/697,292

(22) Filed: Oct. 31, 2003

(51) Int. Cl.[7] ..... B24B 21/00
(52) U.S. Cl. ..... 451/304; 451/310
(58) Field of Search ..... 451/11, 162, 164, 451/168, 297, 304, 310, 340, 296

(56) References Cited

U.S. PATENT DOCUMENTS 4,926,602 A * 5/1990 Crouch ..... 451/296
4,939,870 A * 7/1990 Wang ..... 451/296
6,102,787 A * 8/2000 Schroeder et al. ..... 451/304
6,283,841 B1 * 9/2001 Wang ..... 451/296
6,471,568 B1 * 10/2002 Wang ..... 451/168

* cited by examiner

*Primary Examiner*—Dung Van Nguyen
(74) *Attorney, Agent, or Firm*—Troxell Law Office PLLC

(57) ABSTRACT

A grinding-band swaying device for a band grinding machine includes a motor pivotally connected with a machine base and driving an endless grinding band around two rollers and forming a fulcrum for swaying, a speed-reducing unit and an eccentric wheel. The speed-reducing unit is positioned under the motor, having a shaft connected with the eccentric wheel. An elastic compressing unit is provided between the speed-reducing unit or the motor and the machine base, and then the eccentric wheel is kept to elastically urge the machine base. When the motor together with the speed-reducing unit rotates the eccentric wheel, the speed-reducing unit, the motor and the roller sway regularly with the fulcrum and then the endless grinding band moves forward and also sways regularly synchronously to perform grinding against a work with grinding angles constantly altered to achieve balanced grinding result.

4 Claims, 9 Drawing Sheets

GRINDING-BAND SWAYING DEVICE FOR A BAND GRINDING MACHINE

BACKGROUND OF THE INVENTION

1. Field of the Invention

This invention relates to a band grinding machine, particularly to one having a grinding-band swaying device possible to sway the grinding band of a band grinding machine for regularly changing grinding angles of the grinding band against a work in order to upgrade ground quality of a work.

2. Description of Prior Arts

A known conventional band-grinding machine shown in FIG. 1 includes a machine base 11, a worktable 12, a grinding-band wheelbase 13 and a motor 14. The worktable 12 is positioned on the machine base 11, with the grinding-band wheelbase 13 pivotally connected on the machine base 11. Further, two rollers 131 are positioned at the left side and the right side of the worktable 12, and an endless grinding band 132 extends around the two rollers 131. The motor 14 is fixed at the left side of the machine base just under the left roller 131 and connected with a swaying member 15, having its output end combined with the left roller 131 so as to drive the grinding band move around the two rollers 131. Further, an eccentric device 16 is provided to work with the motor 14, consisting of a main wheel 161 combined with the motor 14, and an eccentric shaft 1611 fixed laterally on the main wheel 161, and a swaying shaft 162 pivotally connected with the eccentric shaft 1611. The swaying shaft 162 is firmly connected with the endless grinding band 13. Therefore, when the motor 14 rotates the main wheel 161, the eccentric shaft 1611 makes eccentric movement so that the grinding band 132 may sway laterally back and forth together with linear straight movement, caused by the stationary condition of the grinding-band wheelbase 13 and the swaying shaft 162.

However, the eccentric device 16 in the conventional band-grinding machine 10 has a disadvantage of a complicated structure, and the swaying shaft 162 has one end directly connected firmly with the band-grinding wheelbase 13. Then the main wheel 161 indirectly actuates the swaying shaft 162 via the eccentric shaft 1611, so the swaying shaft 162 may be interfered by the connected end with the grinding band wheelbase 13, resulting in unsmooth operation of the eccentric swaying. Moreover, the combining structure of the two ends of the swaying shaft 162 has to share the load of the motor 14 so the eccentric shaft 1611 may become gradually worn off by long-term usage, with the service life of the machine possible to be shortened. Further, an universal joint would have to be used for the connecting locations for the swaying shaft 162 and the grinding-band wheelbase 13 and the eccentric shaft 1611, the structure should become quite complicated to end in high cost of the conventional band grinding machine.

SUMMARY OF THE INVENTION

A principal objective of the invention is to offer a grinding-band swaying device for a band grinding machine, which has rollers driven by a motor so as to sway a grinding band back and forth in the lengthwise direction so that grinding angles between a work and the grinding band vary incessantly to achieve balanced surface of the ground portion. Thus, the service life of the grinding band can be prolonged by constant alteration of the grinding location of the grinding band against the work.

Another objective of the invention is to offer a grinding-band swaying device for a band grinding machine, having an eccentric wheel and an elastic compressing unit not fixed together to ensure smooth swaying of the grinding band and to prevent the swaying device from getting damaged.

BRIEF DESCRIPTION OF DRAWINGS

This invention will be better understood by referring to the accompanying drawings, wherein.

DETAILED DESCRIPTION OF THE PREFERRED EMGODIMENT

Figure 1:
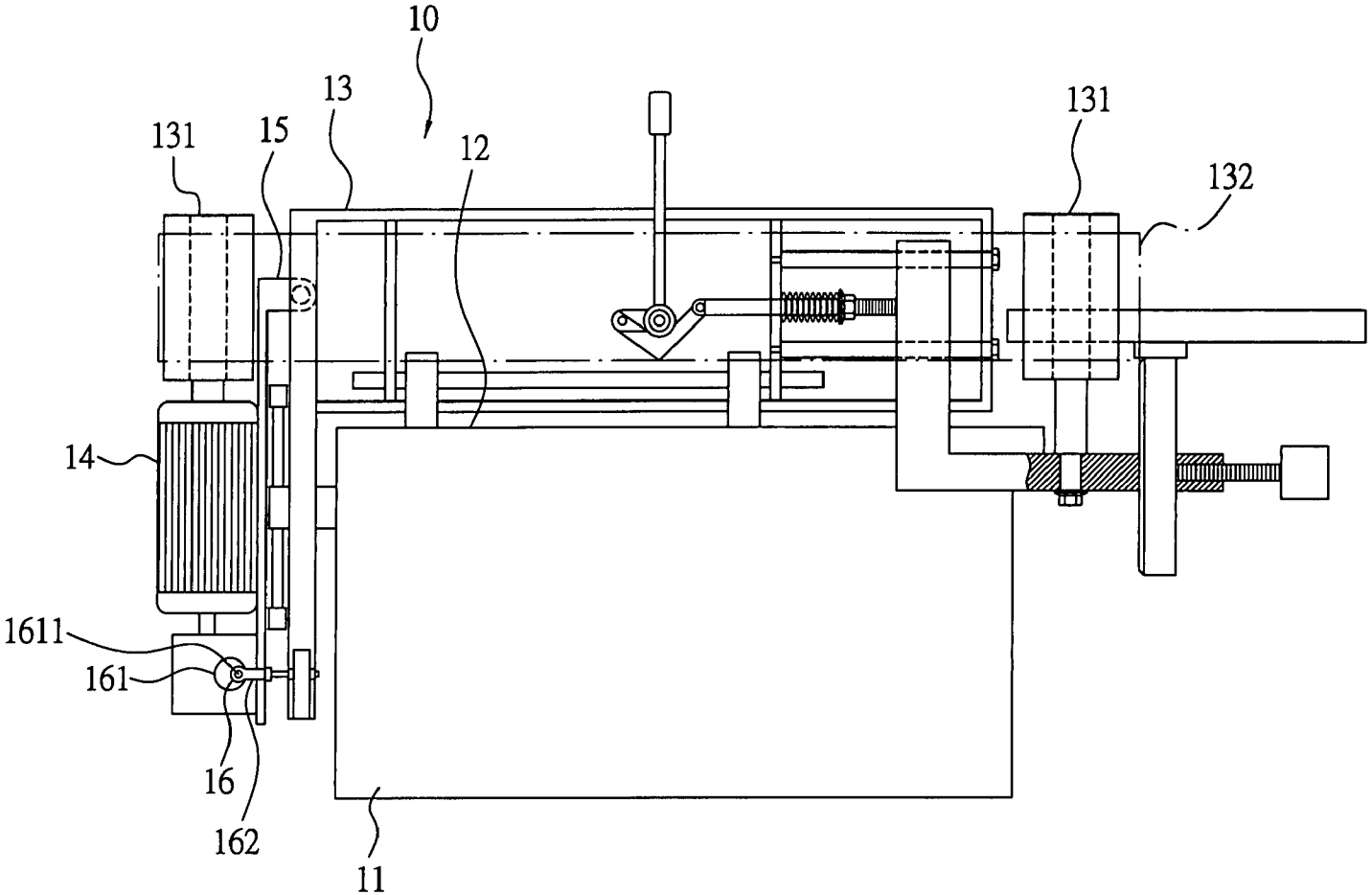
FIG. 1 PRIOR ART
FIG. 1 is a perspective view of a conventional band-grinding machine.
Figure 2:
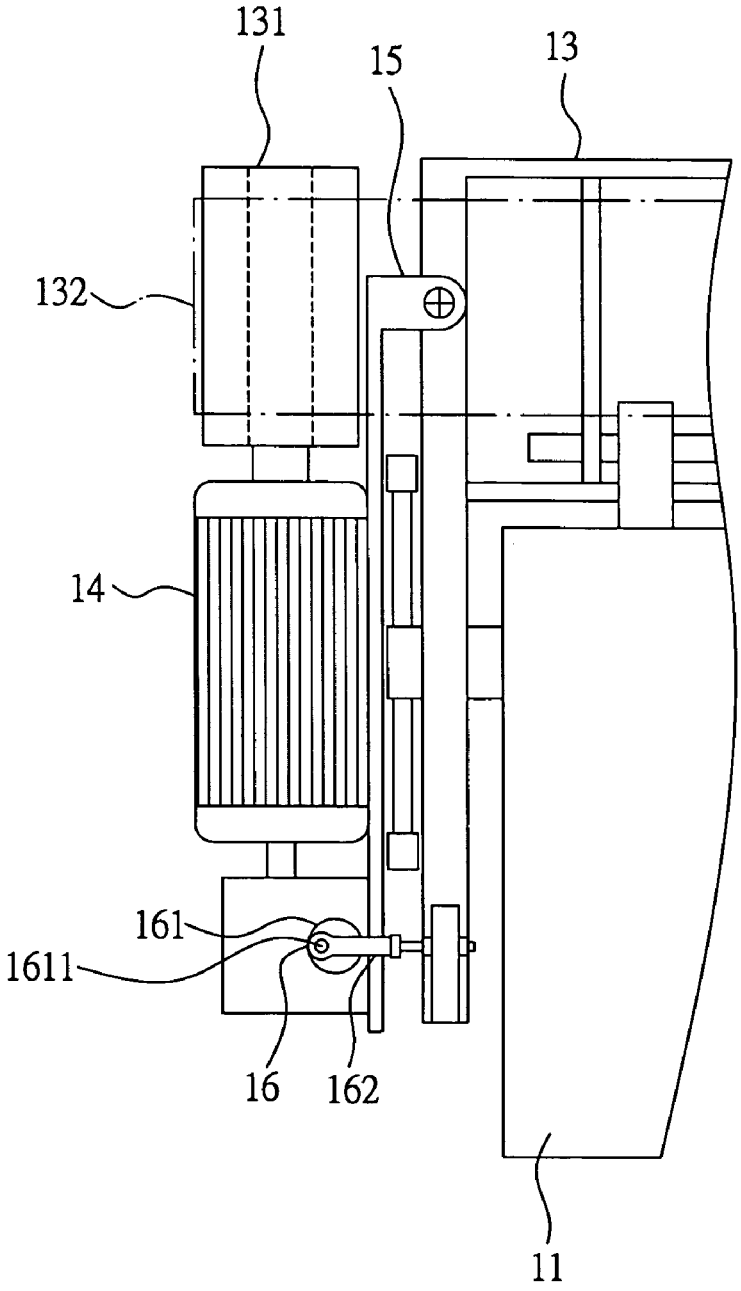
FIG. 2 PRIOR ART
FIG. 2 is a front view of an eccentric device in the conventional band-grinding machine.
Figure 3:
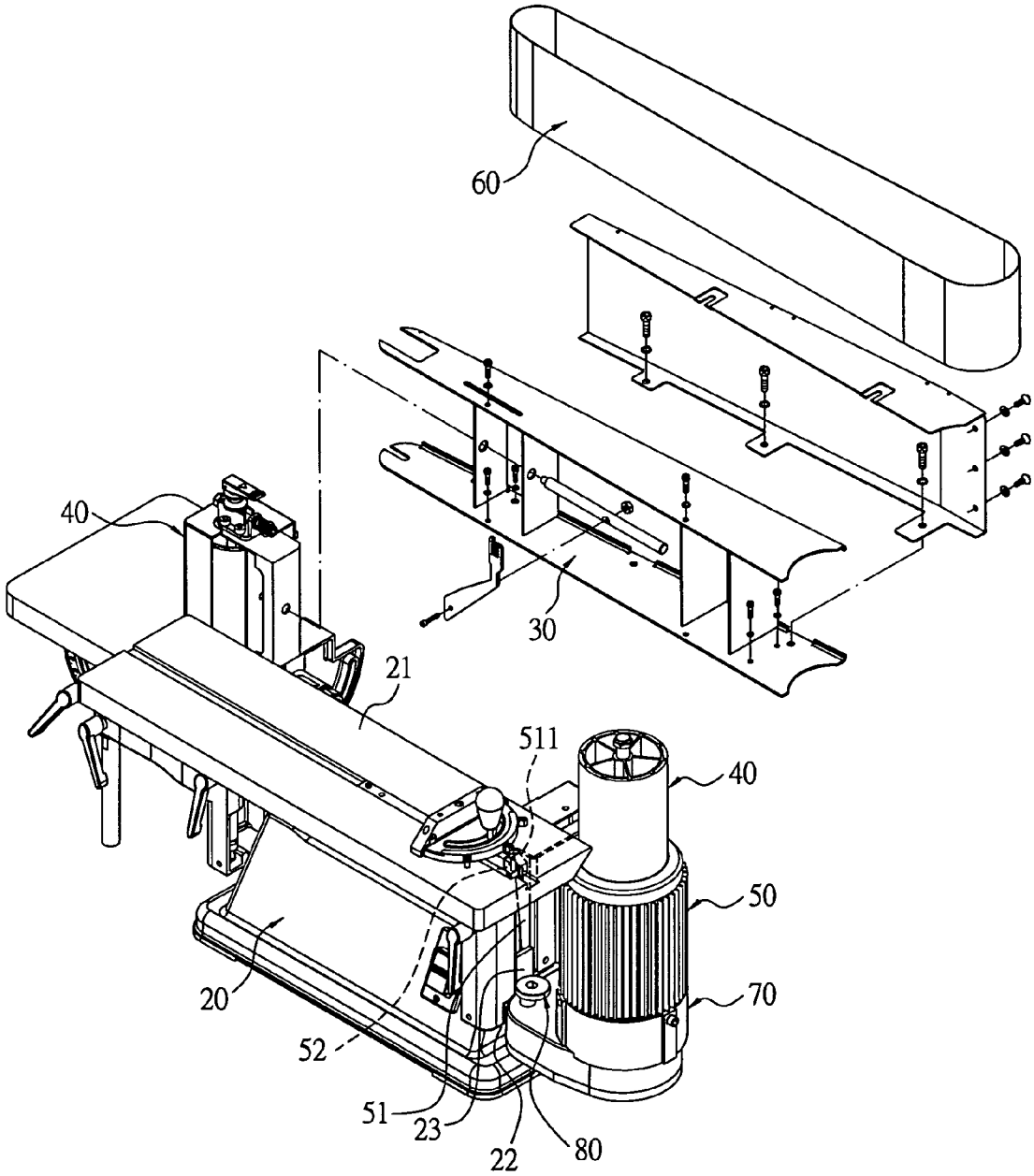
FIG. 3 is a grinding-band swaying device for a band-grinding machine in the present invention.
Figure 4:
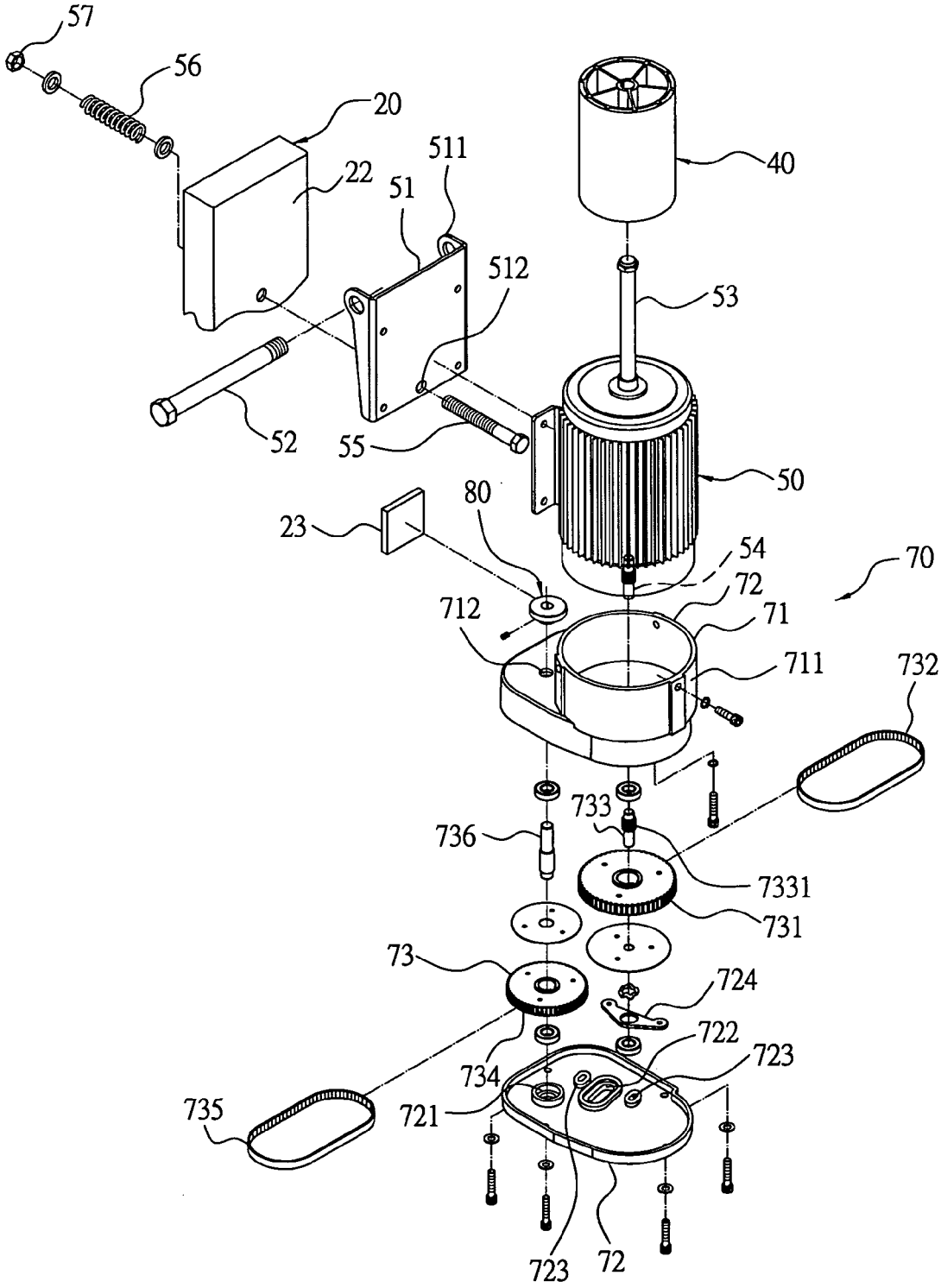
FIG. 4 is an exploded perspective view of the grinding-band swaying device in the present invention.
Figure 5:
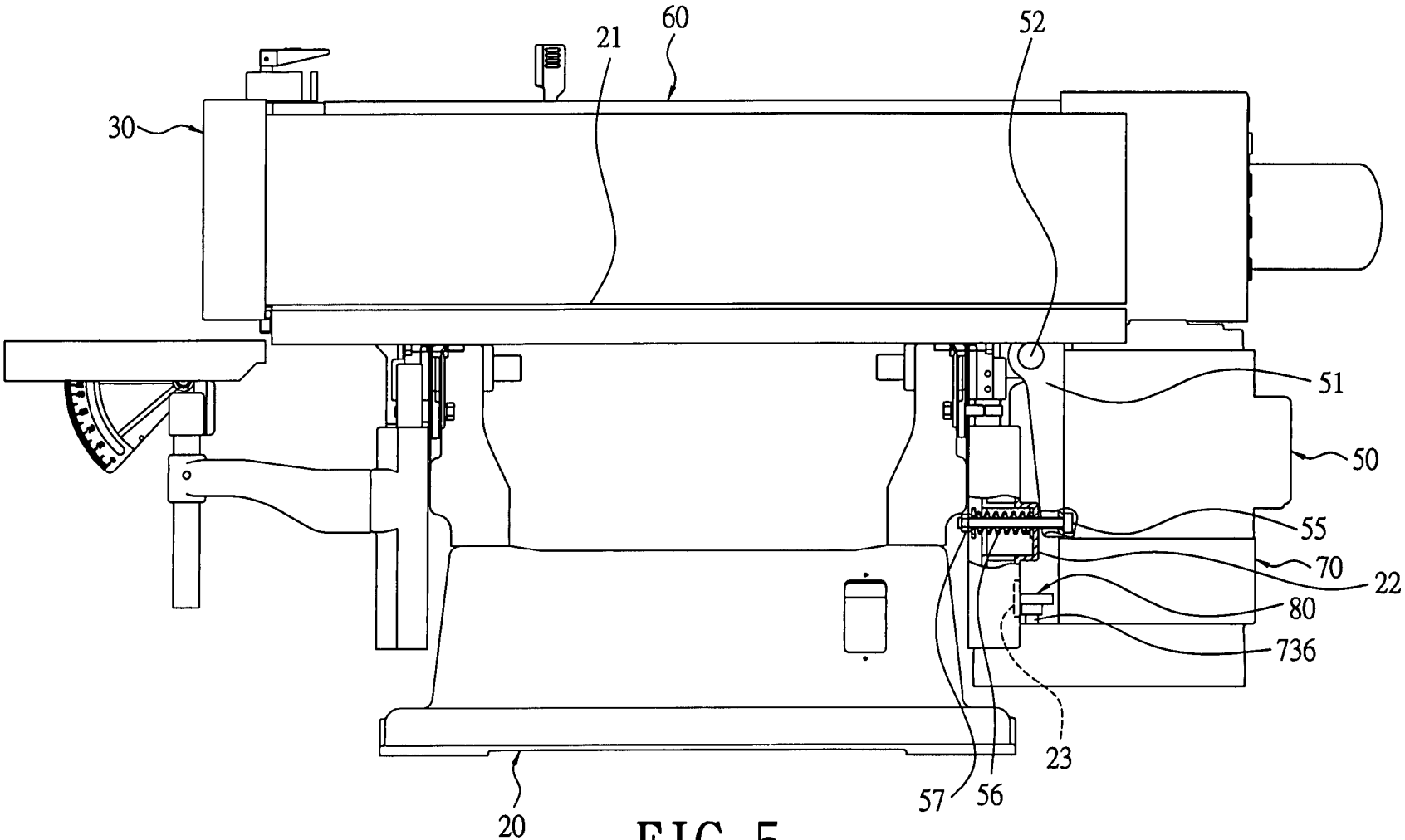
FIG. 5 is a front view of the band-grinding machine in the present invention.

A preferred embodiment of a grinding-band swaying device for a band grinding machine in the present invention, as shown in FIGS. 3, 4 and 5, includes a worktable 21 positioned on a machine base 20, an upper frame 30 provided n the worktable 21, two vertical rollers 40 combined with the upper frame 30, a motor 50 driving one of the rollers 40, an endless grinding band 60 extending around the two rollers 40, a speed-reducing unit 70 and an eccentric wheel 80

The motor 50 is fixed with an pivotal plate 51 at an inner side, and the pivotal plate 51 has two studs 511 formed to extend inward from two ends, cooperating with a rotatable shaft 52 pivotally connected with the machine base 20 to function as an eccentrically rotating point. The motor 50 has an upper spindle 53 and a lower spindle 54 respectively connected with and rotating one of the two rollers 40. Further, an elastic compressing unit (S) is provided on the pivotal plate 51, which has a hole 512 in a lower portion, a bolt 55 screwing through the hole 512 in the wall 22 of the machine base 20, with a coil spring 56 fitting around a outer portion of the bolt 55 and with a nut 57 screwing tightly with the bolt 55 for compressing the spring 56. Then the spring 56 elastically presses against the wall 22 of the machine base 20, having resilience to push back the motor 50 to its original position, always keeping the eccentric swaying function.

Figure 6:
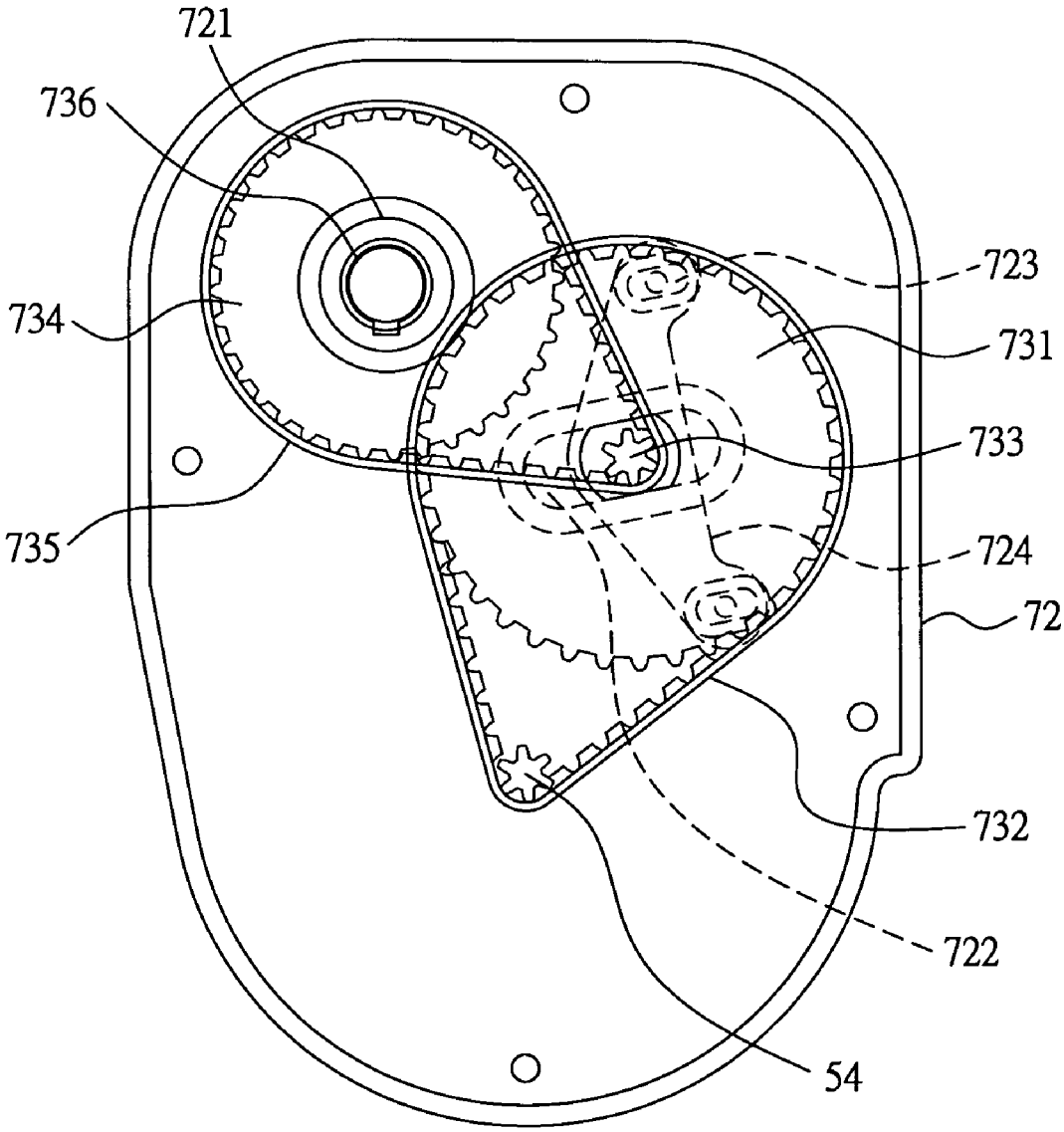
FIG. 6 is a front view of a speed-reducing unit in the present invention.

The speed-reducing unit 70 is provided under the motor 50, as shown in FIG. 6, consisting of a shell 71, a bottom cap 72, and a transmitting unit 73. The shell 71 has an upper combining ring 711 just fitting firmly around a lower portion of the motor 50, and a bottom portion with a hole 712 near the ring 711. The bottom cap 72 closes up the bottom of the shell 71, having an intermediate slot 722, and two slide slots 723 at two sides of the intermediate slot 722, with all the sliding direction of the three slots 722 and 723 being the same. Further, a connector 724 is positioned on the intermediate slot 722, having two ends screwed with the two slide slots 723 with screws with the screwed locations adjustable by sliding.

The transmission unit 73 consists of a first gear 731 of a large diameter, an endless belt 732 extending around the first gear 731 and the lower spindle 54 of the motor 50, a first shaft 733 fixed through the center of the first gear 731 and having an annular teeth 7331 around its upper portion and its lower end passing though the connector 724 to be fixed in the slot 72. Therefore, the first gear 73 can move up in the intermediate slot 722 together with the connector 724. Further the transmission unit 73 has a second gear 734, and a second shaft 736 extending through the center of the second gear 734 and fixed in the hole 712 of the shell 71. Then the output force of the motor 50 is reduced by the transmission unit 73 and transmitted as output by the second shaft 73. In addition, the two endless belts 732 and 735 are tightened properly by adjustment by the first gear 731.

The eccentric wheel 80 is fixed with the second shaft 736 of the speed reducing unit 70, kept to sway eccentrically toward the inner direction and pressing against the wall 22 of the machine base 20. In this embodiment, a press plate 23 of a low friction coefficient and of anti-grinding feature is additionally provided at the outer side of the wall 22, permitting the eccentric wheel 80 rotate much smoothly against the press plate 23.

Figure 7:
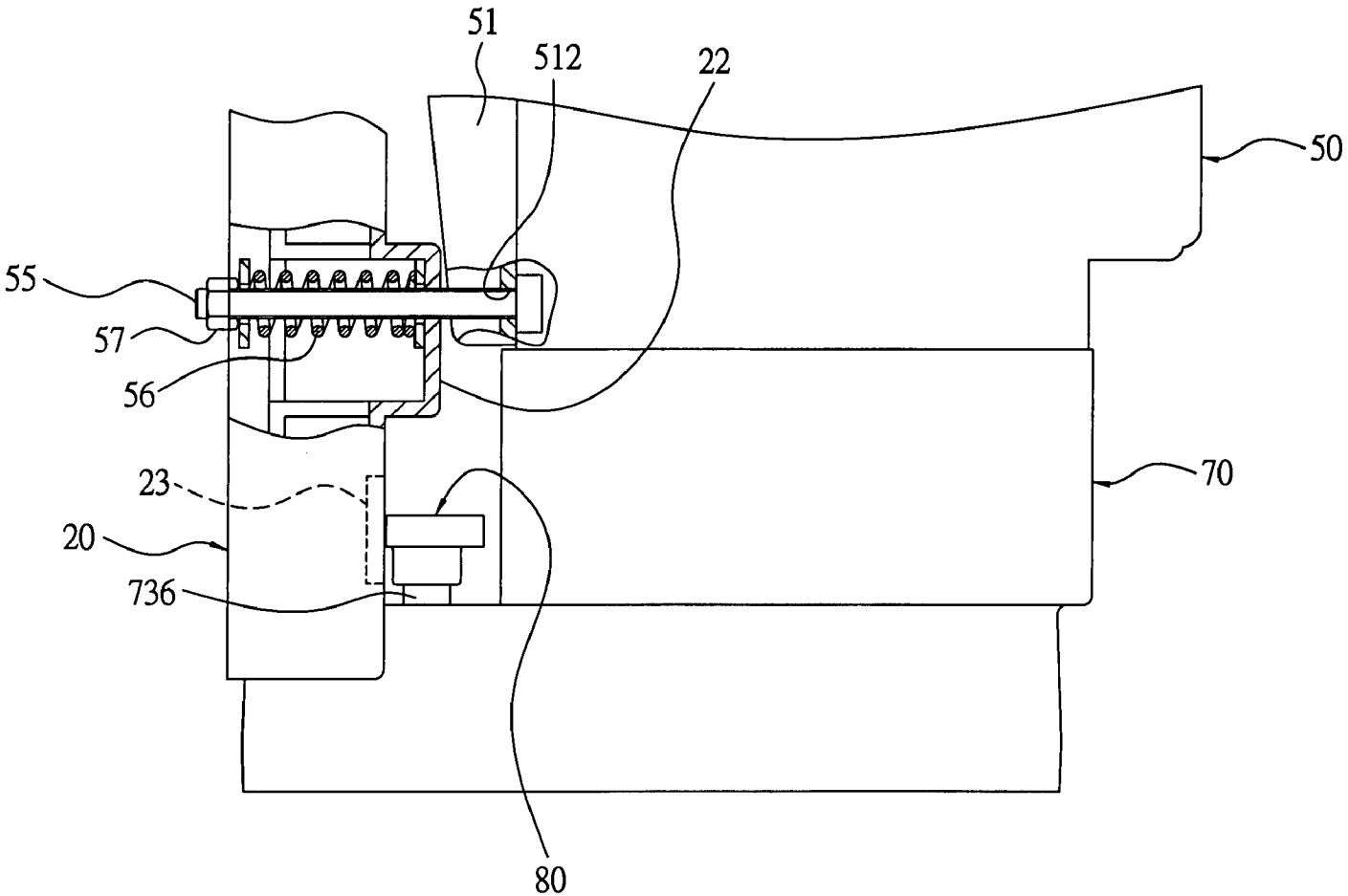
FIG. 7 is a side view of an eccentric wheel with related portion in the present invention.
Figure 8:
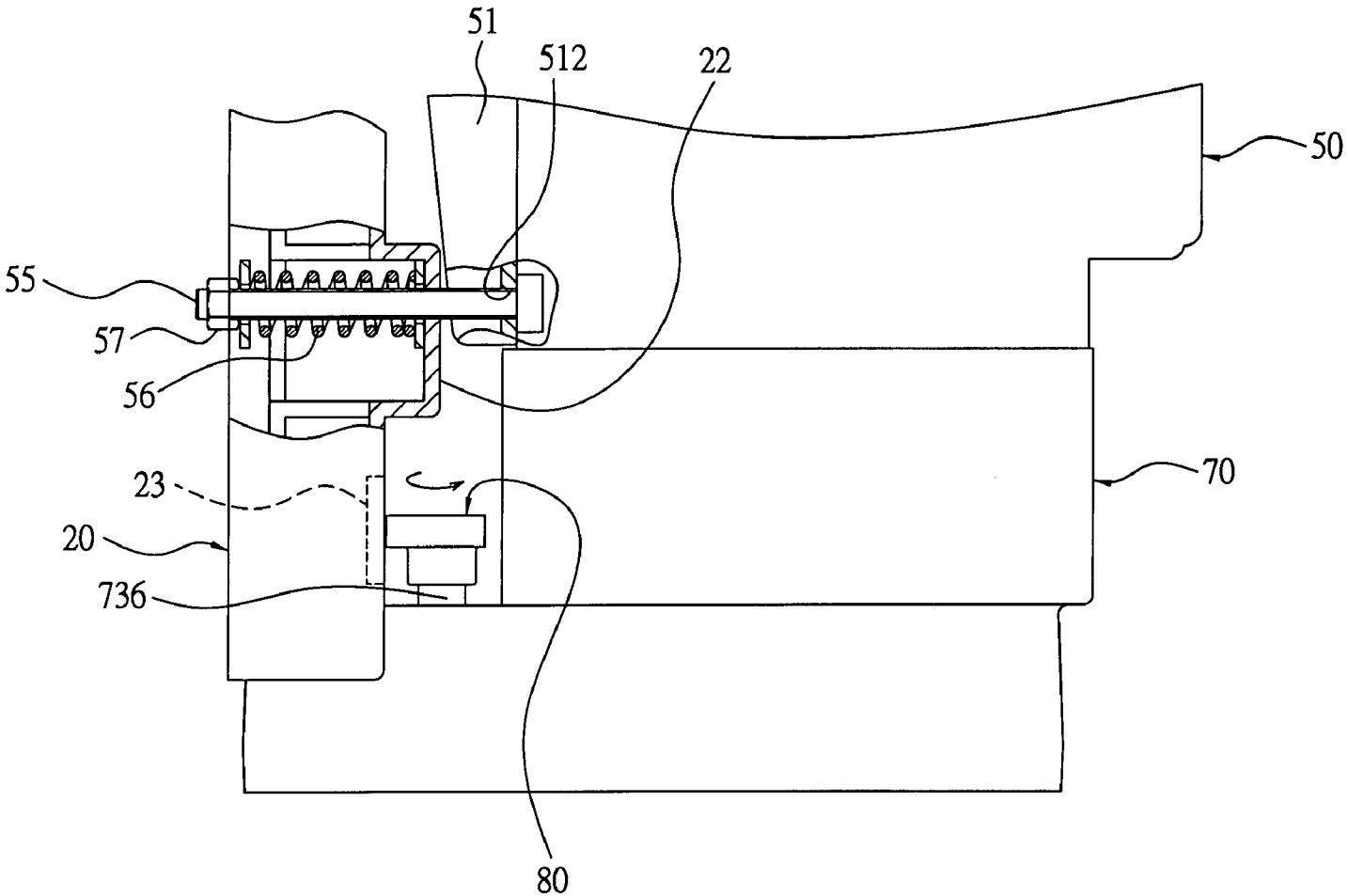
FIG. 8 is a side view of the eccentric wheel under motion in the present invention; and, FIG. 9 is a side view of another embodiment of an elastic compressing unit in the present invention.

In using, referring to FIGS. 5, 7 and 8, when the motor 50 is started, the spindle 51 rotates the roller 40 to drive the grinding band 60 to make grinding action to one side, and the lower spindle 54 also rotates the speed-reducing unit 70 to reduce the rotating speed of the second shaft 736, which then rotates the eccentric wheel 80, which then is held elastically urging the press plate 23 of the machine base 20 due to the coil spring 56 positioned between the pivotal base plate 51 and the machine base 20. Thus, the eccentric wheel 80 is ensured to be kept in an elastic compressing condition against the press plate 23 so the eccentric wheel 80 and the press plate 23 can produce correct interaction. When the eccentric wheel 80 increase its biasing force, the speed-reducing unit 70 along with the motor 50 and the roller 40 may rotate eccentrically by the pivotal connecting point of the motor 50 and the machine base 20. Then the roller 40 on the motor 50 sways a little inward, and then the grinding band 60 on the roller 40 also produce lengthwise upward biasing during moving around the two rollers 40, constantly altering grinding angles against a work being ground, In the same principle, when the biasing distance gradually decreases, the grinding band produces lengthwise downward biasing. Thus the grinding band 60 makes regular biasing during moving around the two rollers 40 by means of the swaying action of the speed-reducing unit 70 and the motor 50, incessantly altering grinding angles against a work being ground, resulting in the surface of a work with good ground quality.

Figure 9:
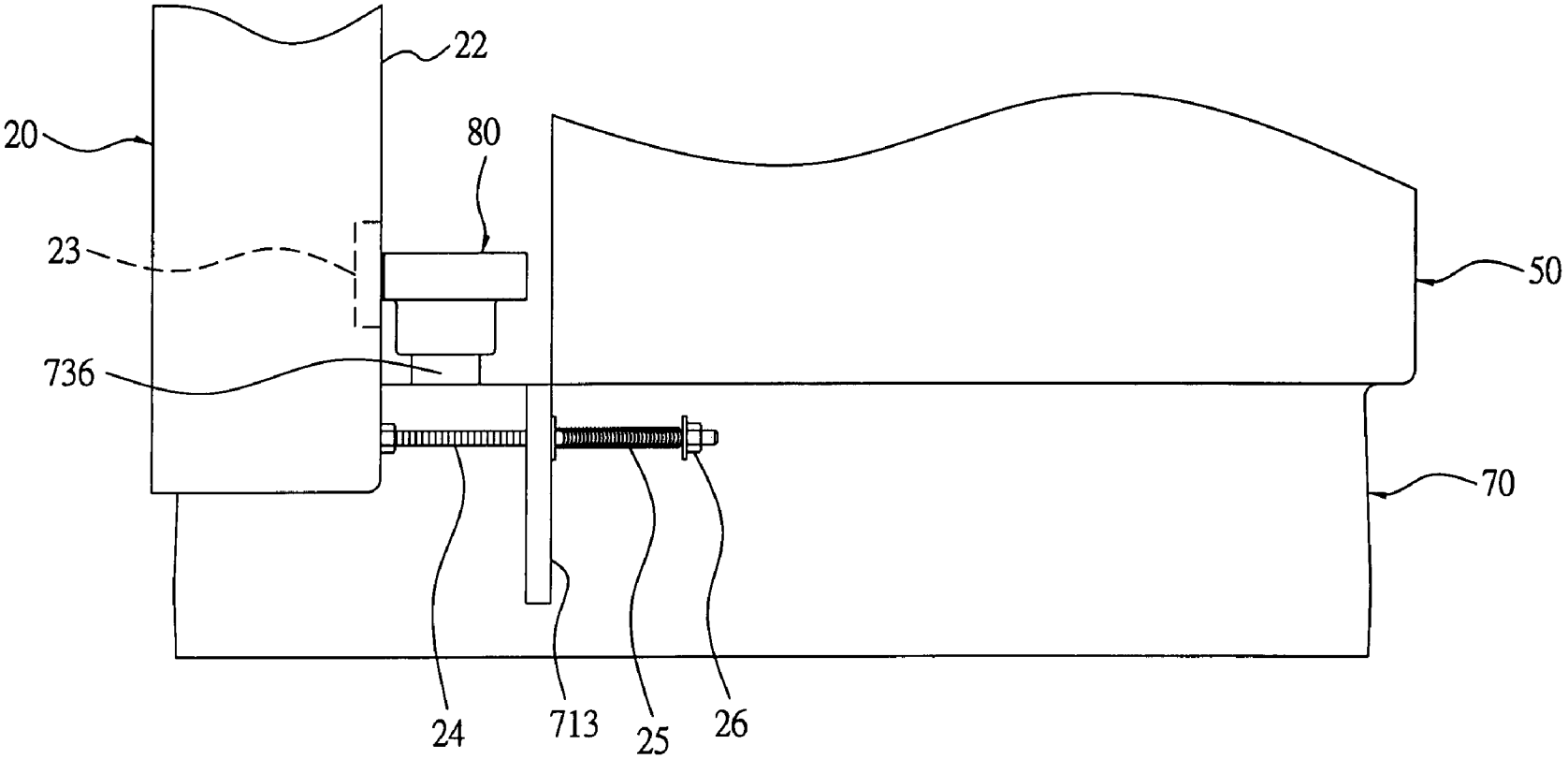

Next, as shown in FIG. 9, another embodiment of an elastic compressing unit (S) is illustrated, consisting of a shell 71 provided with a pivotal plate 713, a shaft 24 provided having one end contacting the machine base 20 and the other end passing through pivotal plate 713 and screwed with a nut 26, with a coil spring 25 fitting around the portion extending out of the pivotal plate 713. The spring 25 can elastically push the pivotal plate 713 towards the machine base 20. Therefore, the pivotal plate 713 may elastically bias towards the machine base 20, together with the whole speed-reducing unit 70, the motor 50 and the roller 40 connected with the motor 50. Likewise, the eccentric wheel 80 on the speed-reducing unit 70 may have elasticity against the machine base 20, rotating to actuate the motor 50 together with the roller 40 to sway upward and downward lengthwise. It is worthy to say that the motor 50 and the speed-reducing unit 70 are composed integral as one component, and so long as the motor 50 or the speed-reducing unit 70 is provided with the elastic compressing unit (S), the connecting members on the motor 50 or the speed-reducing unit 70 can be swayed towards the machine base 20 to force the eccentric wheel 80 kept elastically urging the machine base 20 or the wall 22 beneficial for swaying action.

While the preferred embodiment of the invention has been described above, it will be recognized and understood that various modifications may be made therein and the appended claims are intended to cover all such modifications that may fall within the spirit and scope of the invention.

What is claimed is:

1. A grinding-band swaying device for a band grinding machine, said band grinding machine having a worktable on a machine base, an upper frame positioned on the worktable, two upright rollers positioned at two ends of said upper frame, one of said two rollers separated from said upper frame and connected with and driven by a motor, an endless grinding band extending around and moved by said two rollers, said grinding band grinding a work placed vertically on said worktable, said grinding-band swaying device comprising:

a pivotal plate provided near said machine base and connected with said motor, said pivotal plate pivotally connected with a corresponding wall of said machine base, said pivotal plate combined with an elastic compressing unit at a preset location, said elastic compressing unit elastically urging said motor towards said machine base, said motor having an upper spindle extending up from its top and a lower spindle extending down from a bottom, said upper spindle connected with a shaft of said roller:

a speed-reducing unit positioned under said motor and connected with and driven by said lower spindle, said speed-reducing unit diminishing the rotating speed of said lower spindle and transmitting it to a shaft:

an eccentric wheel fixed on and driven by the shaft of said speed-reducing unit, said eccentric wheel keeping elastic compressing against a wall of said machine base by elastic pressing of said motor against said machine base:

said eccentric wheel overcoming the elastic pressing of said elastic compressing unit to force said speed-reducing unit, said motor and said roller sway outward when said eccentric wheel rotates, said eccentric wheel also swaying inward by recovery of the elasticity of said elastic compressing unit so that said eccentric wheel may force said speed-reducing unit, said motor and said roller sway upward and downward regularly (in other words, reciprocate).

2. The grinding-band swaying device for a band grinding machine as claimed in claim 1, wherein said speed-reducing unit consists of a shell fitting firmly around a lower portion of said motor, a bottom cap closed up the bottom of said shell, a transmission unit arranged in said shell, said transmission unit having gears and endless belts for transmitting rotating force and for reducing rotating speed, a last one of said gears having a shaft extending up through said shell and driving said eccentric wheel to rotate, a first one of said gears having its shaft extending down to said bottom cap and sliding thereon to control tightness of said endless belts.

3. The grinding-band swaying device for a band grinding machine as claimed in claim 1, wherein said elastic compressing unit consists of a position bolt extending from said pivotal plate connected with said motor to the inner side of said wall of said machine base, a coil spring fitting around an inner portion of said position bolt inside said wall, a nut screwing with an end of said bolt and compressing said coil spring so said coil spring always urges against an inner surface of said wall of said machine base, thus said motor and the connecting components kept elastically urging towards said machine base.

4. The grinding-band swaying device for a band grinding machine as claimed in claim 1, wherein said elastic compressing unit is provided on said speed-reducing unit, consisting of a shaft with one end connected with a preset location of said wall of said machine base and with the other end extending through and out of said pivotal plate with a coil spring fitting around the outer portion and then screwing tightly with a nut so that said coil spring may always elastically compress said pivotal plate together with said speed-reducing unit and the connecting components on said same unit toward said machine base.

* * * * *